US005836514A

United States Patent [19]

Handfield

[11] Patent Number: 5,836,514

[45] Date of Patent: Nov. 17, 1998

[54] SNOWMAKING GUN

[76] Inventor: Louis Handfield, 5-95 Sault-au-Matelot, Quebec City QC, Canada, G1K3Y9

[21] Appl. No.: 687,606

[22] PCT Filed: Feb. 22, 1995

[86] PCT No.: PCT/CA95/00090

§ 371 Date: Aug. 8, 1996

§ 102(e) Date: Aug. 8, 1996

[87] PCT Pub. No.: WO95/23320

PCT Pub. Date: Aug. 31, 1995

[30] Foreign Application Priority Data

Feb. 24, 1994 [CA] Canada ..... 2116368

[51] Int. Cl.[6] ..... F25C 3/04

[52] U.S. Cl. ..... 239/14.2; 239/416.5; 239/423

[58] Field of Search ..... 239/2.2, 14.2, 239/416.5, 417, 420, 422, 423

[56] References Cited

U.S. PATENT DOCUMENTS

| | | | |
|---|---|---|---|
| 3,387,791 | 6/1968 | Allenbaugh, Jr. | 239/458 |
| 4,284,242 | 8/1981 | Randell | 239/423 |
| 4,491,273 | 1/1985 | Manhart | 239/14.2 |
| 4,711,395 | 12/1987 | Handfield | 239/14.2 |
| 4,742,959 | 5/1988 | Stanchak et al. | 239/14.2 |
| 4,903,895 | 2/1990 | Mathewson et al. | 239/14.2 |
| 4,917,297 | 4/1990 | Terhume | 239/14.2 |
| 5,083,707 | 1/1992 | Holden | 239/14.2 |
| 5,167,367 | 12/1992 | VanderKelen et al. | 239/2.2 |
| 5,180,106 | 1/1993 | Handfield | 239/14.2 |

*Primary Examiner*—Andres Kashnikow
*Assistant Examiner*—Lisa Ann Douglas
*Attorney, Agent, or Firm*—George A. Seaby

[57] ABSTRACT

A relatively efficient snowmaking gun which is of the compressed air and water type includes a water tube for receiving water from a source thereof under pressure and discharging the water in an annular diverging stream through an adjustable valve and a turbine which chops the water into fine droplets; and a central nucleator for receiving compressed air from a source thereof and for producing a central stream of fine ice particles downstream of the discharge end of the gun for mixing with the water to produce snow, temperature permitting. A preferred form of nucleator is an ultrasonic resonator for receiving air and water from sources thereof under pressure to produce an annular central stream of fine water droplets in air while creating ultrasonic waves downstream of the gun outlet. The gun can also include a casing defined by inner and outer shells surrounding the water tube and forming an air chamber which receives compressed air for discharge through a plurality of spaced apart nozzles. The air from the nozzles forms an annular diverging stream of air for mixing with the water from the water tube and the fine droplets or nuclei produced by the central nucleator or resonator.

13 Claims, 11 Drawing Sheets

SNOWMAKING GUN

This invention relates to a snowmaking gun, i.e. a gun for producing artificial snow.

As discussed in applicant's pending Canadian patent application Serial No. 2,082,140, filed Nov. 4, 1992, in general, the basic process for producing artificial snow (involving the formation of ice crystals) is a heat exchange process involving heat rejection. When sufficient heat has been removed under proper temperature conditions, small droplets of water will freeze. There are four major factors affecting the removal of heat from water droplets, namely:

(1) the flight time of the droplets, (2) the temperature differential between the ambient air and the water droplets, (3) the relative humidity of the air and the barometric pressure, and (4) the diameter and surface area of the droplets.

The basic types of snowmaking apparatuses in use today include the so-called compressed air type and the fan type. In a compressed air apparatus, air and water are supplied to snow guns for atomizing, projection and distribution of an air/water mixture. A fan type apparatus includes a large tubular casing containing a fan for producing a large volume of air. Water is atomized hydraulically and injected into the air stream produced by the fan. Direct nucleation is required with this type of apparatus. All snowmaking apparatuses must achieve the same objectives, namely the atomizing of water droplets, the projection of the droplets into air so that they can freeze, and the nucleation of water droplets to enhance freezing in the minimum time at the highest possible temperature. Moreover, it is desirable to achieve the foregoing as economically as possible.

In the vast majority of compressed air type apparatuses, air and water are mixed prior to being discharged from a nozzle as a mixture. The compressed air facilitates internal mixing and nucleation. The high velocity of the mixture results in freezing of smaller droplets to create nuclei. The compressed air also provides most of the force necessary to project the droplets into the air. The secondary or entrained ambient air provides the largest part of the cooling required to convert the water droplets into ice particles.

Each type of apparatus has its advantages and disadvantages. Compressed air snow guns are lightweight, structurally simple, easy to operate, store and transport, relatively problem free on the slopes, more efficient in marginal temperatures, and better adapted to steep and narrow slopes. However, such guns are noisy, result in high energy consumption and costs, and experience higher water evaporation losses. Fan type machines have lower energy consumption and costs, higher snowmaking capabilities, lower noise level and less water evaporation than compressed air/water guns. Unfortunately, fan type machines are large and heavy, difficult to use on steep slopes, and are more complicated to operate, requiring better skills than the compressed air/water gun.

Comparison of a fan type machine (see U.S. Pat. No. 4,711,395, which issued to the present inventor on Dec. 8, 1987 with the best compressed air guns resulted in the conclusion that the fan type machine converts water into snow while using less than one fifth the energy required by the best air/water guns operating at peak efficiency.

As a general principle, the quantity of snow produced is directly proportional to the quantity of water employed. However, at any given temperature and humidity, and for a specific volume of air, only limited quantities of water may be sprayed into the air and result in high quality, dry snow.

Thus, for any snowmaking machine, there is a trade off between snow quantity and quality which vary in accordance with climate conditions. As mentioned above, the production of artificial snow is a heat exchange process in which the actual heat exchange occurs at a distance from the apparatus or gun. Thus, a relatively important part of the system is the plume of air and water interacting with ambient air outside of the apparatus. In order to ensure efficient snowmaking, it is important to ensure that (1) proper mixing of water droplets and air occurs in the plume outside the machine, (2) the water droplets remain airborne for a sufficient period of time to become frozen, and (3) energy consumption be kept to a minimum.

Recently, there has been a great deal of activity in the area of artificial snowmaking. In general, the effort has been concentrated in the area of mixing within the machine, i.e. of creating a mixture of air and water within the gun. Very little effort has been addressed to increasing the interaction of air and water in the plume itself which is acknowledged to be most important area in the heat exchange process.

For a given nozzle, the degree of atomization is a function of the supply pressure of the fluids, and the mass ratio of the air and water. Existing compressed air guns rely on the production of homogeneous mixture in the guns. With such guns, the air and water must be introduced at approximately the same pressure (70 to 150 psi). Once a discharge orifice size has been chosen, the operating conditions and characteristics with respect to available air/water ratios for given fluid pressures are established. Moreover, the use of fixed orifices for air and water means that water can be adjusted only by varying the water pressure. At marginal temperatures, guns operate with minimum water flow, i.e. minimum water pressure. In such circumstances, when it is most needed, the full potential momentum energy of the pressurized water supply is not utilized.

In the earlier Canadian patent application mentioned above, the inventor provides a snowmaking gun of the compressed air/water type which maintains the advantages of small size, weight and portability while adding positive features normally associated with fan type machines, namely low energy consumption and high snowmaking capabilities. As a result of further research, it has been found that the performance of earlier guns of this type can be improved even more by making modifications which promote atomizing of water and the mixing of water and air downstream of the discharge end of the gun. One such modification involves the use of ultrasonic waves generated at the discharge end of the gun.

The object of the present invention is to provide a relatively efficient snowmaking gun with low energy requirements which atomizes water using ultrasonic vibrations and otherwise ensures thorough mixing of air and fine water droplets outside of the gun.

Accordingly, the present invention relates to a snowmaking gun comprising:

(a) casing means including (i) outer shell means, (ii) inner shell means defining an air chamber and nozzle means for discharging air from said air chamber in an outer annular stream;

(b) water tube means extending substantially entirely through said inner shell means for receiving water from a source of water under pressure, said tube means having an outlet end for discharging the water from the gun;

(c) valve means at said outlet end of said water tube means for controlling the volume of water discharged from said water tube means, and for shaping the water into a primary thin hollow film and then into an intermediate annular stream of small water droplets for discharge into the center of the outer annular stream of air exiting said nozzle means for mixing with said outer stream of air downstream of the discharge end of the gun for producing snow, temperature permitting; and (d) resonator means extending through said water tube means for receiving air and water from sources thereof under pressure, and for producing an annular central stream of fine water droplets in air while creating ultrasonic waves downstream of the outlet end of the gun to promote the atomization of water in all said streams.

When the resonator means described in subparagraph (d) above is simply a nucleator, i.e. a device for receiving air under pressure to produce a stream of five ice particles, the invention relates to a snowmaking gun comprising:

(a) casing means including
  (i) outer shell means,
  (ii) inner shell means defining an air chamber and nozzle means for discharging air from said air chamber in an outer annular stream;

(b) water tube means extending substantially entirely through said inner shell means for receiving water from a source of water under pressure, said tube means having an outlet end for discharging the water from the gun;

(c) valve means at said outlet end of said water tube means for controlling the volume of water discharged from said water tube means, and for shaping the water into a primary thin, hollow film and then into an intermediate annular stream of small water droplets for discharge into the center of the outer annular stream of air exiting said nozzle means for mixing with said outer stream of air downstream of the discharge end of the gun for producing snow, temperature permitting; and (d) nucleator means extending through said water tube means for receiving air from a source thereof under pressure, and for producing a central stream of fine ice particles which act as nuclei for promoting the production of snow.

In its simplest form, the invention involves a snowmaking gun comprising:

(a) water tube means for receiving water from a source thereof under pressure, said tube means having an outlet end for discharging the water from the gun;

(b) valve means at the outlet end of said water tube means for controlling the volume of water discharged from said water tube means, and for shaping the water into an annular stream of small water droplets; and (c) nucleator means extending through said water tube means for receiving air from a source thereof under pressure, and for producing a central stream of fine ice particles for mixing with the small water droplets downstream of the discharge end of the gun to produce snow, temperature permitting.

The invention is described hereinafter in greater detail with reference to the accompanying drawings, which illustrate a preferred embodiment of the invention, and wherein.

Figure 3:
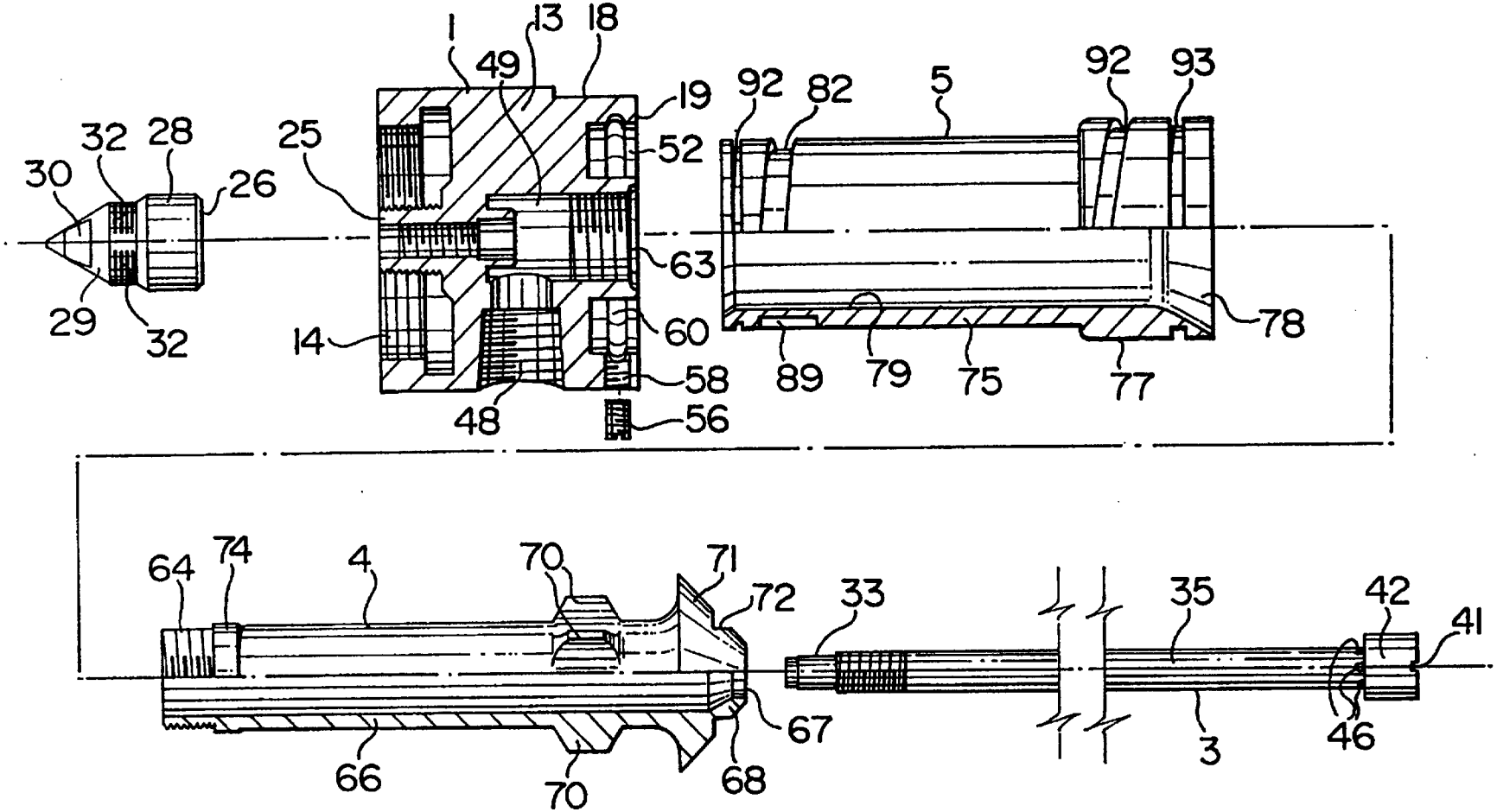
FIG. 3 is a partly sectioned, exploded side view of an inlet filter, an inlet manifold, a water tube, a resonator tube and a resonator stem used in the gun of FIGS. 1 and 2.
Figure 4:
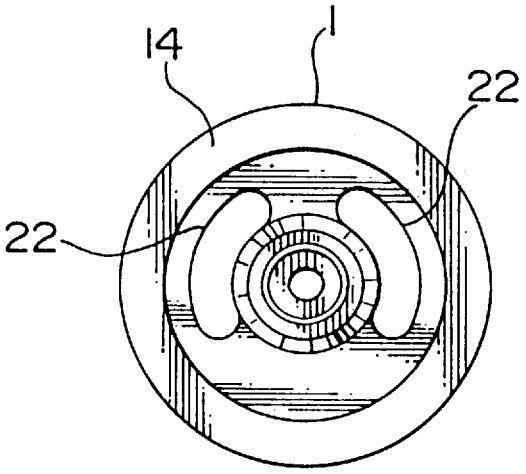
FIG. 4 is an end view of the inlet manifold of FIG. 3 as viewed from the left or inlet end thereof.
Figure 11:
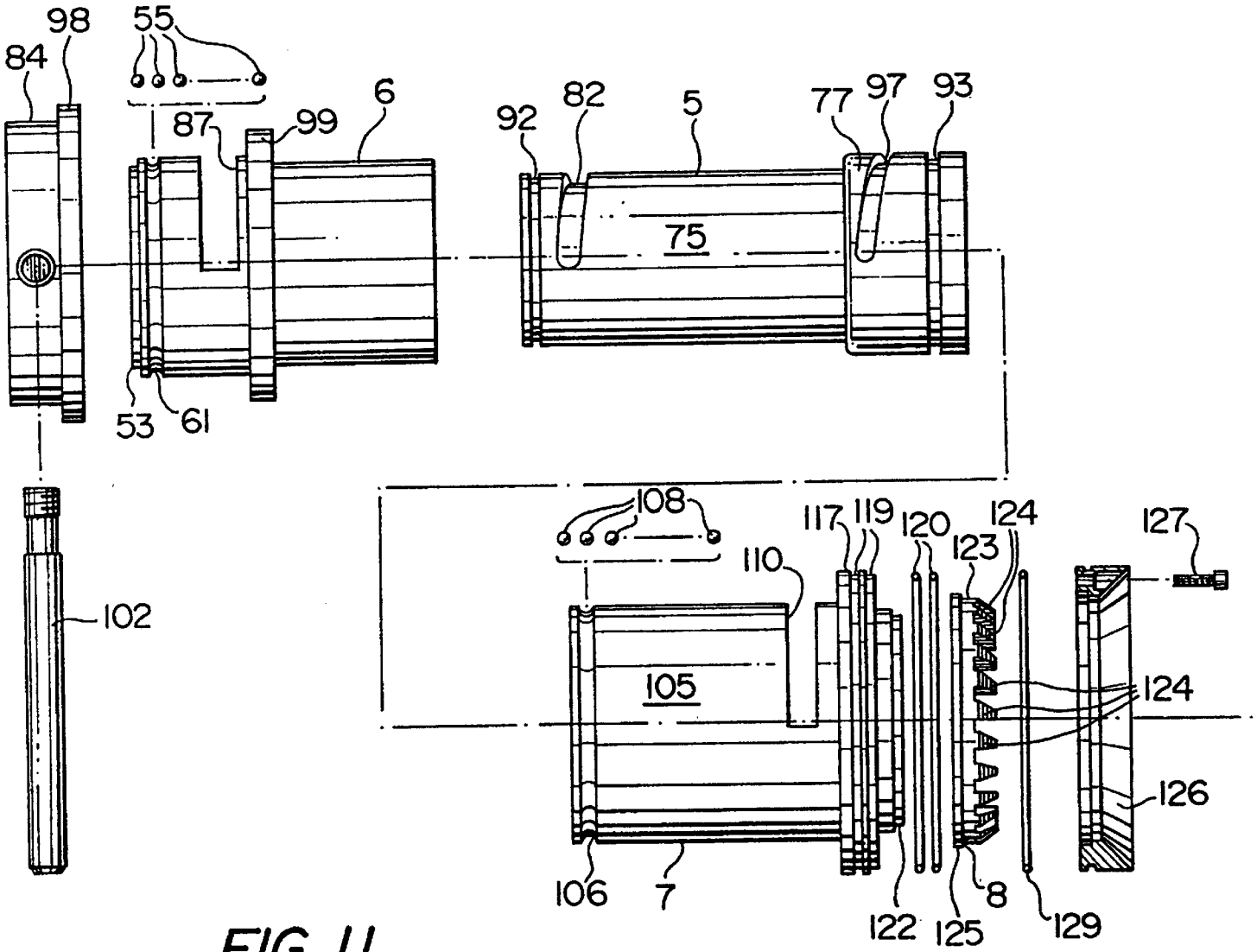
FIG. 11 is an exploded side view of a nozzle body, water and air pattern control assemblies and a turbine used in the gun of FIGS. 1 and 2.
Figure 14:
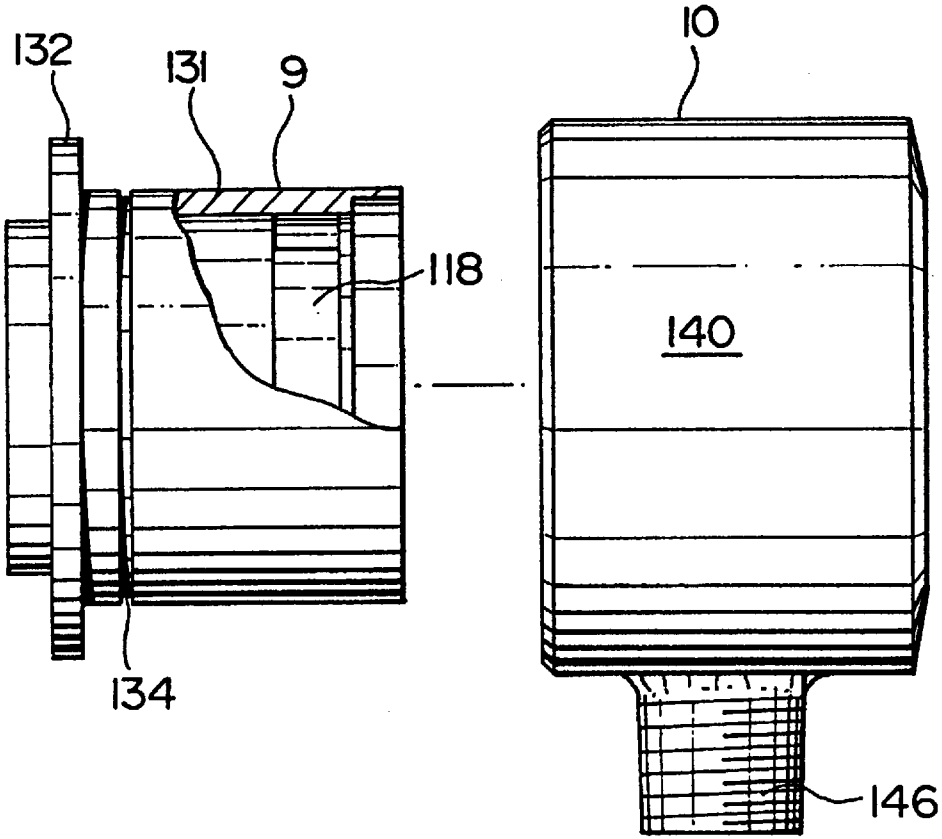
FIG. 14 is a partly sectioned, exploded side view of inner and outer shells used in the gun of FIGS. 1 and 2.
Figure 15:
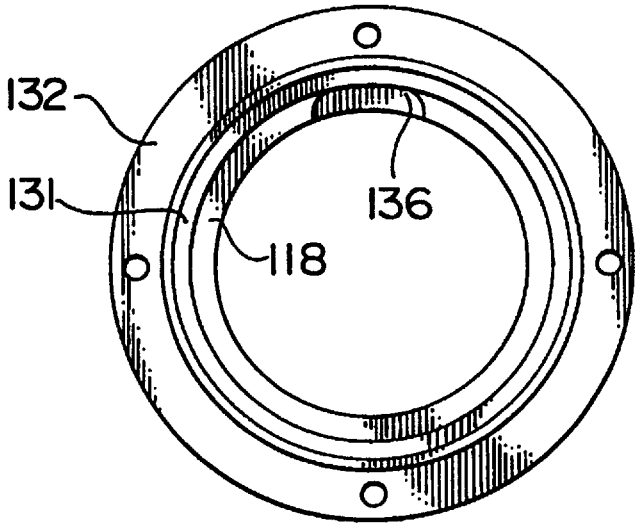
FIG. 15 is an end view of the inner shell as viewed from the right of FIG. 14, i.e. the outlet end of the shell.
Figure 16:
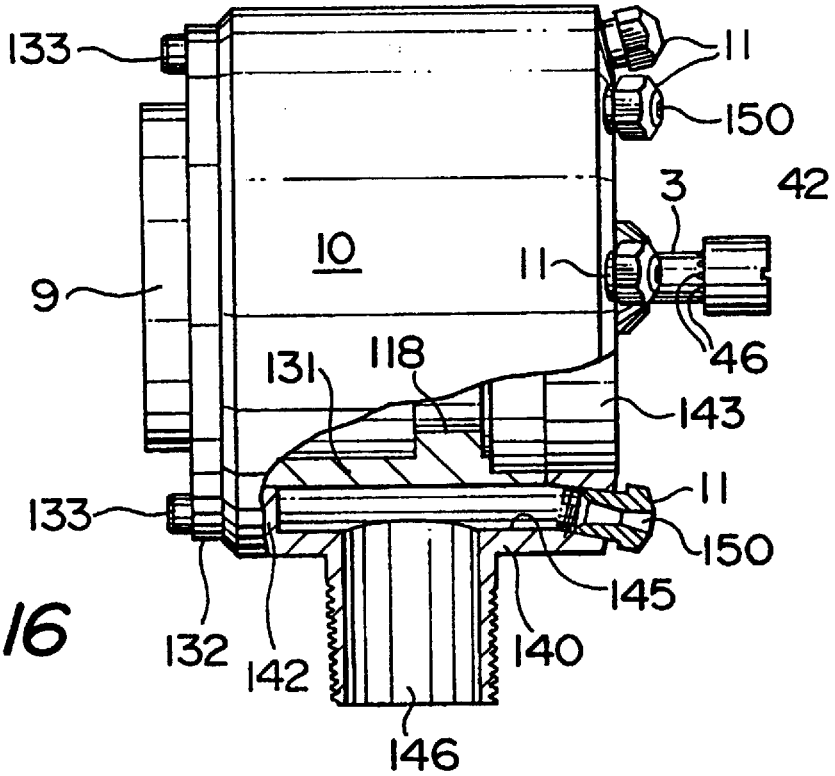
FIG. 16 is a partly sectioned, side view of the shells of FIG. 14 in the assembled condition, air nozzles in the outer shell and the outlet end of the resonator stem of FIGS. 3 and 7.

It will be appreciated that when FIGS. 3, 11 and 14 are placed end-to-end with their counterlines aligned, they illustrate the complete gun in the disassembled condition.

Figure 1:
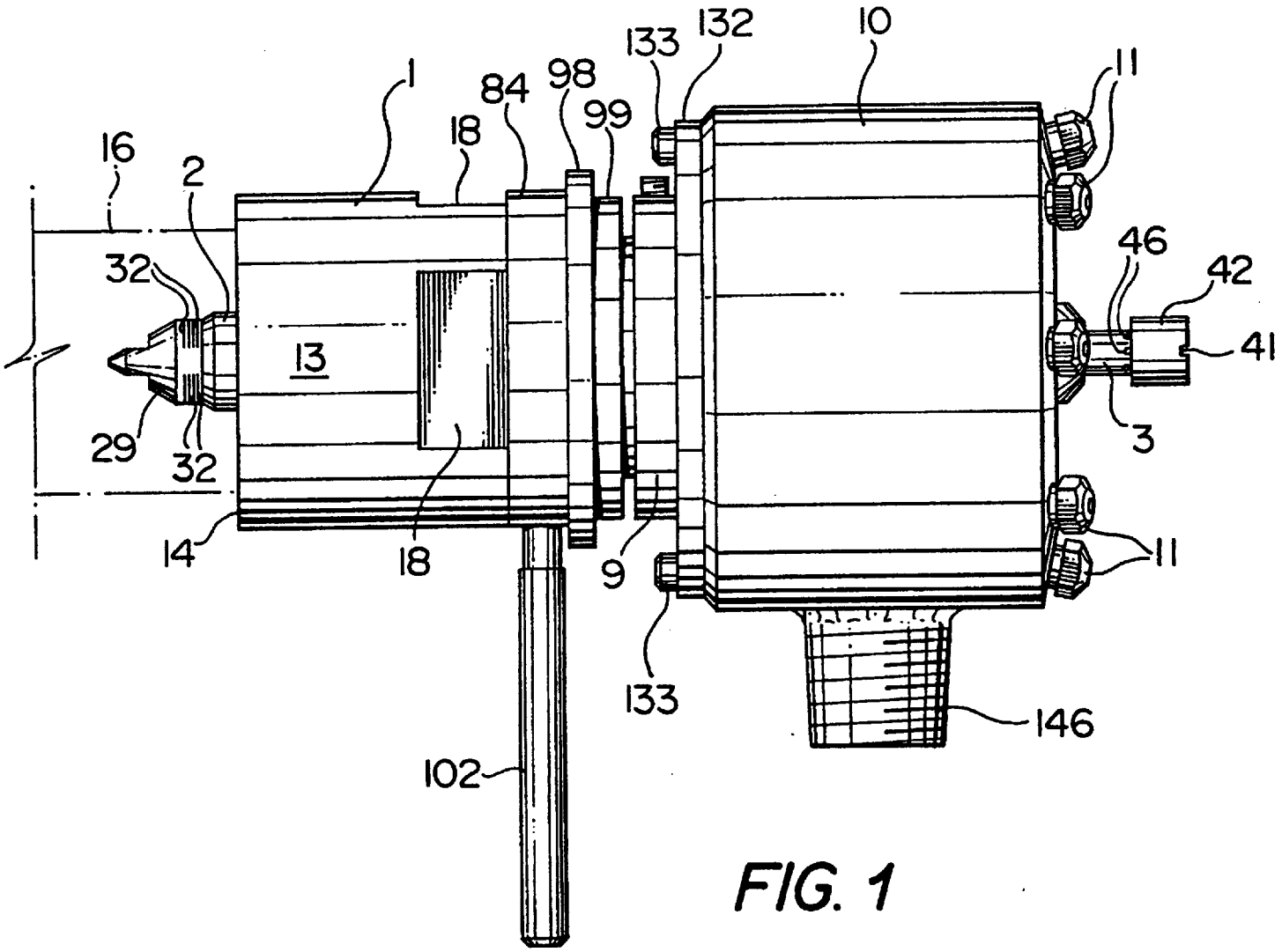
FIG. 1 is a side view of a snowmaking gun in accordance with the present invention.
Figure 2:
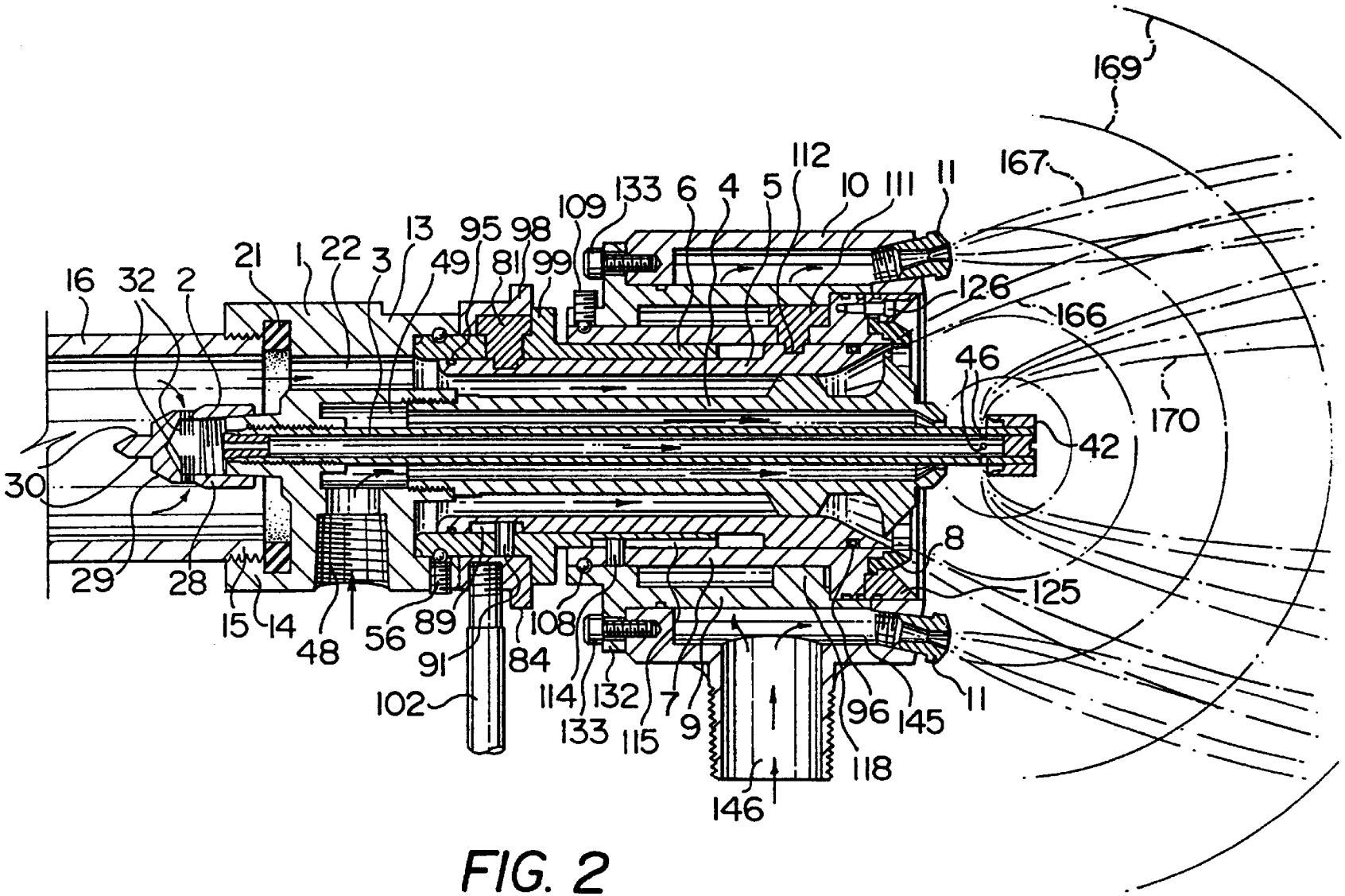
FIG. 2 is a longitudinal sectional view of the gun of FIG. 1.

Referring to FIGS. 1 and 2, the basic elements of the snowmaking gun include an inlet manifold 1, a water inlet filter 2, a resonator stem 3, a resonator tube 4, a water tube 5, a water volume control sleeve 6, a water pattern control sleeve 7, a plastic turbine 8, an inner shell 9, an outer shell 10 and air outlet nozzles 11.

Figure 5:
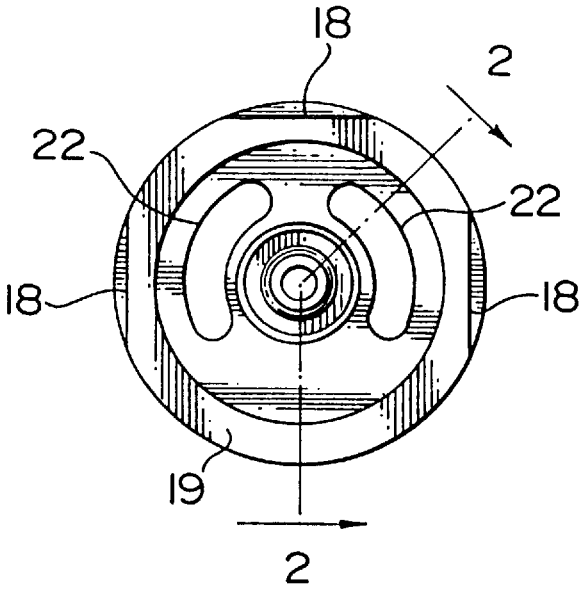
FIG. 5 is an end view of the inlet manifold of FIG. 3 as viewed from the right or outlet end thereof.
Figure 6:
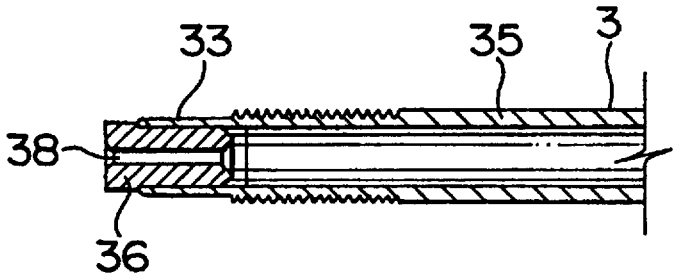
FIG. 6 is a longitudinal sectional view of the inlet end of the resonator stem of FIG. 3.
Figure 7:
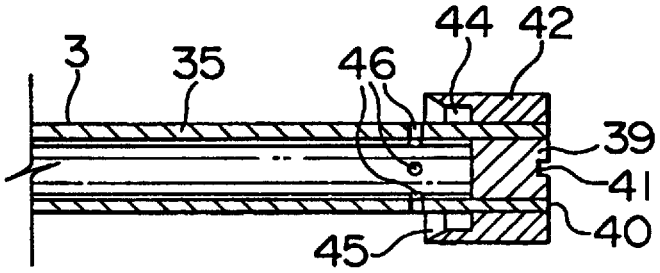
FIG. 7 is a longitudinal sectional view of the outlet end of the resonator stem of FIG. 3.
Figure 8:
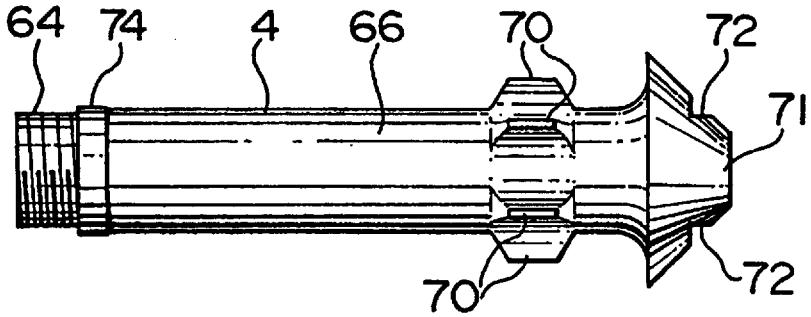
FIG. 8 is a side view of the resonator tube of FIG. 3.
Figure 9:
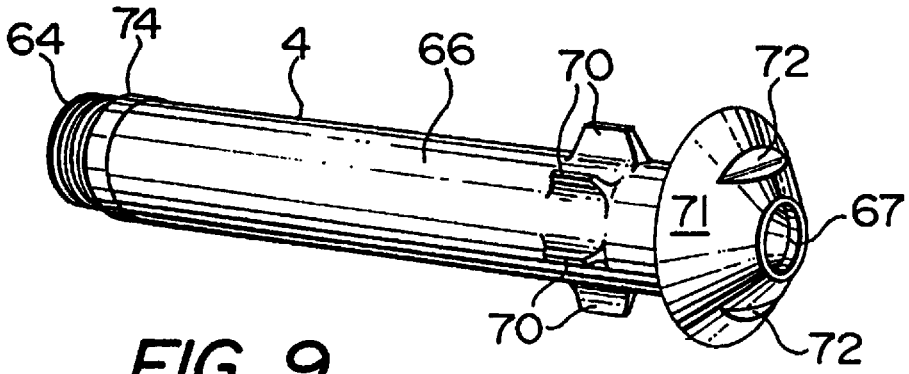
FIG. 9 is a perspective view of the resonator tube of FIG. 8.
Figure 10:
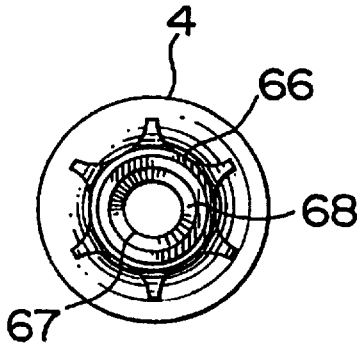
FIG. 10 is an end view of the resonator tube of FIGS. 8 and 9.

As best shown in FIGS. 2 to 6, the inlet manifold 1 is defined by a metal body 13 with an internally threaded, annular inlet end 14 for receiving the externally threaded end 15 of a pipe 16, which connects the gun to a source of water under pressure (not shown). Flat areas 18 (FIG. 5) are provided on the top and each side of the body 13 near the outlet or downstream (in the direction of water flow) end 19 thereof for facilitating tightening of the connection between the body 13 and the pipe 16. In FIG. 5 the section lines 2—2 indicate the location of the longitudinal section of the inlet manifold shown in FIG. 2. A gasket 21 forms a seal between the end 15 of the pipe 16 the interior of the body 13. Water entering the body 13 from the pipe 16 flows through arcuate passages 22 extending longitudinally of both sides of the body.

An externally threaded hub 25 in the center of the inlet end 14 of the body 13 receives the internally threaded end 26 of the inlet filter 2. The filter 2 includes a tubular body 28 with a closed, tapered inlet end 29 facilitating the flow of water past the filter. Flat areas 30 are provided on the inlet end 29 for tightening the filter on the hub 25. Slots 32 extend circumferentially of the body 28 near the inlet end thereof for admitting water to the filter 2 and the inlet end 33 of the resonator stem. The inlet end 33 of the stem 3 is externally threaded for mating with the internally threaded hub 25.

As best shown in FIGS. 2, 3, 7 and 8, the resonator stem 3 includes an elongated, tubular body 35, with a plug 36 (FIG. 7) in the inlet end 33 thereof. A small diameter passage 38 is provided in the plug 36 for admitting water to the body 35. A plug 39 is provided in the outlet end 40 of the body 35. The plugs 36 and 39 are shrink fitted in the body 35. A notch 41 is provided in the outer end of the plug 39 for receiving a screwdriver (not shown), facilitating mounting of the stem.3 in the manifold 1. A cylindrical head 42 (FIG. 8) is securely mounted on the outlet end 40 of the body 35.

The head 42 includes a recess in the upstream end thereof, which defines an annular well 44 around the body 35 of the resonator stem. The upstream end 45 of the head is tapered for promoting flow into and out of the well 44. A plurality of holes 46 extend radially through the body 35 immediately upstream of the head 39 in the direction of fluid flow.

Air from a source thereof under pressure (not shown) is introduced radially into the manifold 1 via a passage 48. The air is discharged through a longitudinally extending central passage 49 in the body 13 of the manifold 1 around the resonator stem 3. An annular recess 52 is provided in the outlet end 19 of the manifold 1 for receiving the inlet end 53 of the volume control sleeve 6 (FIG. 11). The sleeve 6 is connected to the manifold 1 by ball bearings 55 and a set screw 56 (FIG. 3). The ball bearings 55 are inserted through a threaded radially extending hole 58 in the manifold body 13 into an annular passage defined by complementary, opposed annular grooves 60 and 61 in the manifold body 13 and the inlet end 53 of the volume control sleeve 6, respectively. When the set screw 56 is placed in the hole 58 and tightened against the sleeve 6, the manifold 1 and the sleeve 6 are together. If the screw 56 is loosened, the sleeve 6 can rotate on the manifold 1.

The outlet end 63 of the passage 49 in the body 13 is threaded for receiving the externally threaded inlet end 64 of the resonator tube 4. Referring to FIG. 3 and 8 to 10, the tube 4 includes an elongated cylindrical body 66 with a narrow diameter air outlet 67 at the tapered downstream or outlet end 68 thereof. The diameter of the air outlet 67 is larger than the outside diameter of the resonator stem body 35, i.e. a narrow annular outlet slot exists between the tube 4 and the stem 3. Six radially extending vanes 70 are provided near the downstream end of the body 66 for centering the body in the water tube 5. A frusto-conical head 71 on the downstream end of the body 66 acts as a valve body for controlling the volume of water flowing out of the water tube 5. Flat areas 72 on opposite sides of the head 71 facilitate mounting of the tube 4 in the manifold 1. Movement of the tube 4 into the manifold 1 is limited by a shoulder 74.

With reference to FIGS. 3 and 11, the volume control tube 5 is defined by an elongated cylindrical body 75 with a larger diameter shoulder 77 at the discharge end thereof. The outlet end 78 of the central passage 79 through the tube defines an outwardly tapering valve seat for the valve body defined by the head 71 of the resonator tube 4. By moving the tube 5 longitudinally on the tube 4, the opening between the head 71 and the outlet end 78 of the passage 79 can be varied to control the volume of water discharged from the tube 5.

Figure 13:
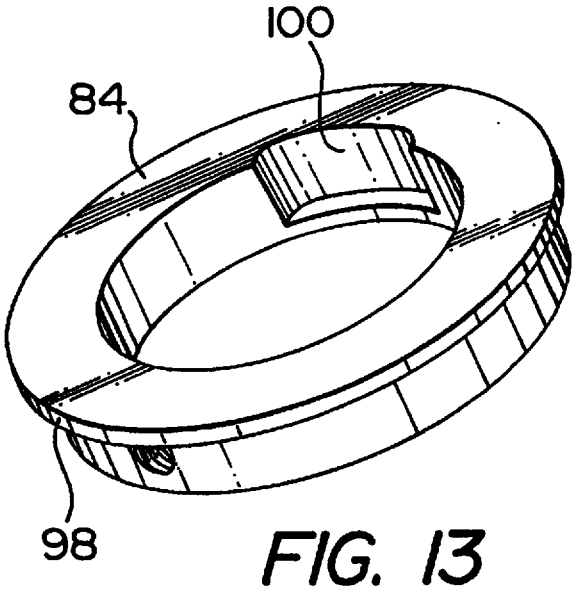
FIG. 13 is a perspective view of a control ring used in the water. volume control assembly of FIG. 11.
Figure 12:
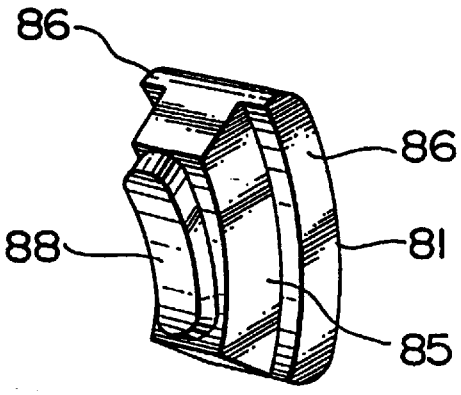
FIG. 12 is a perspective view of a cam used in the water volume control assembly of FIG. 11.

Longitudinal movement of the tube 5 is effected using a cam 81 (FIG. 12) which rides in a groove 82 (FIGS. 3 and 11) in the body 75 and a control ring 84 (FIG. 13) The cam 81 includes an arcuate body, which conforms in curvature to the side curvature of the body 75 of the tube 5. Flanges 86 extend outwardly from the sides of the body 85 for sliding on the tube 5 when the body of the cam is inserted through a semicircular slot 87 in the volume control sleeve 6 into the groove 82. A generally oval lug 88 on the inner surface of the body 85 is inclined or angled with respect to the longitudinal axis of the body 85. The groove 82, which extends around one half of the circumference of the body 75 defines a segment of a helix. A longitudinally extending groove 89 (FIG. 3) is provided in the bottom of the body 75 for receiving a pin 91 (FIG. 2), which extends through the volume control sleeve 6. The pin 91 prevents rotation of the tube 5 in the sleeve 6. A pair of annular grooves 92 and 93 (FIG. 11) are provided near the ends of the tube body 75 for receiving O-rings 95 and 96 (FIG. 2). A second helical groove 97 is provided in the shoulder 77 for use in established water flow pattern control as described hereinafter in greater detail.

The control ring 84 (FIG. 13) includes an annular flange 98, which bears against and slides on an annular flange 99 on the sleeve 36. A recess 100 in the interior of the ring 84 receives the head of the cam defined by the flanges 86 for moving the cam longitudinally in the groove 82. Rotation of the ring 84 is effected using a rod-shaped handle 102. The handle 102 has a threaded end 103 for mounting the handle in the ring 84. Because the water tube 5 cannot rotate in the sleeve 6, rotation of the ring 84 causes longitudinal movement of the tube 5 to alter the gap between the head 71 of the resonator tube 4 and the outlet end 78 of the tube 5, whereby the volume of water flowing through such gap is changed.

The pattern of the annular stream of water discharged from the water tube 5 can be changed by moving the pattern control sleeve 7 and consequently the inner and outer shells 9 and 10, respectively longitudinally with respect to the discharge end of the water tube 5. As best shown in FIGS. 1 and 11, the pattern control sleeve 7 includes a cylindrical body 105 with an annular groove 106 of semicircular cross section near the upstream end thereof for connecting the inner shell 9 to the sleeve. The inner shell 9 is connected to the sleeve 7 in the same manner as the sleeve 6 is connected to the manifold 1, i.e. using ball bearings 108 and a set screw 109. A semicylindrical slot 110 is provided in the body for slidably receiving a cam 111 (FIG. 2). The cam 111 is similar to the cam 81 and includes a lug 112 extending into the groove 97 in the water tube 5. The groove 97 in the shoulder 77 of the water tube 5, the ball bearings 108, the set screw 109 and the cam 111 form a latch device for releasably locking the sleeve 7 in one position. Relative rotation between the pattern control sleeve 7 and the sleeve 6 is prevented by a pin 114 (FIG. 2) extending through the sleeve 9 into a longitudinally extending groove 115 in the sleeve 6.

Figure 17:
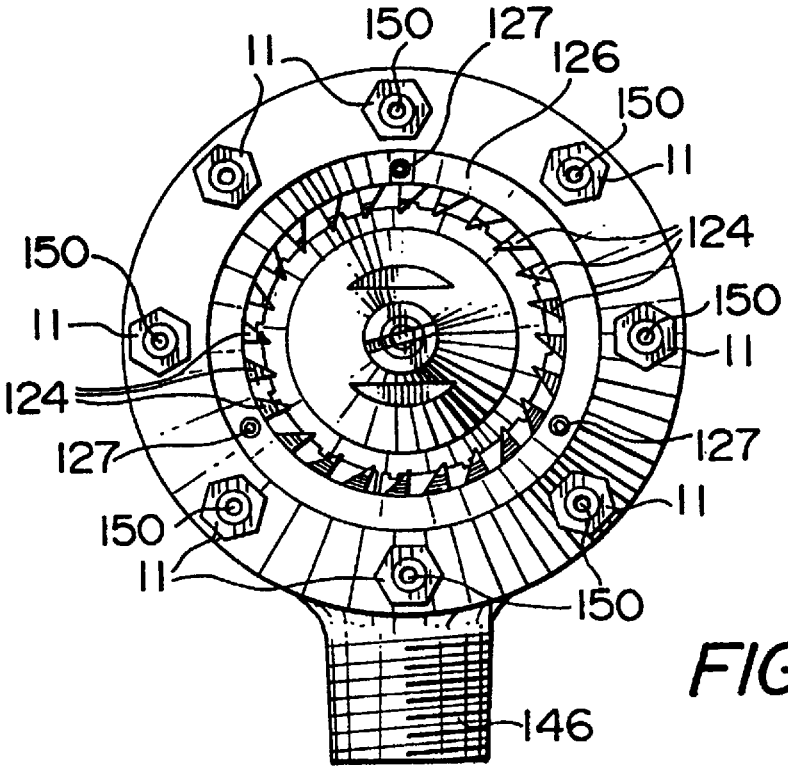
FIG. 17 is an end view of the outlet of the gun as viewed from the right of FIG. 1.

An annular flange 117 extends outwardly from the body 105 near the outlet end of the gun for locating the sleeve 7 against an inwardly extending annular flange 118 in the inner shell 9. Grooves 119 in the flange 117 receive O-rings 120 (FIG. 11) for sealing the sleeve 7 in the inner shell 9. The outlet end 122 of the body 105 is stepped for receiving the turbine 8. The turbine 8 is defined by a ring 123 with generally L-shaped blades 124 extending outwardly therefrom in the direction of fluid flow, and radially inwardly of the longitudinal axis of the gun. The downstream or inner free ends (FIG. 17) of the blades 124 are triangular with bevelled inner edges. A flange 125 is provided on the turbine for bearing against the flange 117 on the pattern control sleeve 7. The turbine 8 is retained on the sleeve 7 by a ring 126 and screw 127. An 0-ring 129 is provided between the ring 126 and the turbine 8.

The inner shell 9 includes a cylindrical body 131 with external annular flange 132 near the inlet end thereof for receiving screws 133 for connecting the inner shell to the outer shell 10. An annular groove 134 near the flange 132 receives an O-ring (not shown) for sealing the upstream end of the inner shell 9 in the outer shell 10. The inwardly extending annular flange 118 contains a slot 136 there-through for receiving the head of the cam 111, so that rotation of the inner and outer shells 9 and 10, respectively results in a corresponding rotation of the cam in the slot 110 in the sleeve 7. Because the sleeve 7 cannot rotate relative to the sleeve 6, rotation of the cam 111 causes longitudinal movement of the sleeve 7 towards the discharge end of the gun. Thus, the flow pattern of water exiting the gap between the head 71 of the resonator sleeve 4 and the end 78 of the valve tube 5 can be varied.

The outer shell 10 is defined by a cylindrical body 140 with annular, inwardly extending flanges 142 and 143 on the inlet and outlet ends thereof. The ends of the inner shell 9 bear against the flanges 142 and 143, and the gap between the shells 9 and 10 defines an air inlet chamber 145. Air under pressure is introduced into the chamber 145 via a threaded inlet pipe 146. The flange 142 is intended to receive the screws 133 connecting the shells 9 and 10 together. A plurality of the air outlet nozzles 11 are mounted in the flange 143 for discharging air from the chamber 145 in an annular, outwardly flaring pattern. The nozzles 11 include central, axially extending passages 150 which first converge and then diverge to provide supersonic velocities and to promote sudden expansion and the loss of heat from the air.

Prior to using the above described gun, the position of the pattern control sleeve 7 is adjusted using the cam 111. The sleeve is then locked in position using the ball bearings 108 and the set screw 109. During operation, water under pressure is introduced into the gun via the pipe 16, the manifold 1 and the filter 2. The water enters the water tube 5 and exits through the gap or valve opening between the shoulder 71 of the resonator tube 4 and the flaring outlet end 78 of the water tube 5. The water impinges on the teeth 124 of the turbine 8, and is thus discharged from the gun in an intermediate stream 166 of fine water droplets.

At the same time, air entering the chamber 145 via the inlet pipe 146 is discharged through the nozzles 11 in a diverging stream 167. Because the nozzles are spaced apart, the air is initially discharged in discrete streams which eliminates a problem encountered with a continuous annular air discharge slot, namely an internal vacuum in the area surrounded by the air stream where ice build up can occur. Because the air expands rapidly, heat is lost and any water (humidity) in the compressed air is transformed into small ice crystals which act as ice seeds. The air and ice crystals mix with the water being discharged from the water tube 5 to create snow, temperature permitting.

The snow making capability of the gun is enhanced by the ultrasonic resonator assembly defined by the stem 3 and the tube 4. The ultrasonic assembly used in the apparatus of the present invention is an edge tone system which includes a nozzle (at the outlet end of the resonator tube 4) and a sharp edge (on the upstream end of the resonator head 42). The sharp edge gives rise to a regular succession of vortices. An acoustical resonator defined by the well or cavity 44 is excited oscillation by the vortices, and determines the frequency of the sound generated by synchronizing eddy production. The main application of ultrasonic dispersion is the atomizing of liquids in a monodispersion form, i.e. the liquid droplets are of substantially uniform size. This type of process is by no means a thermal process. What actually happens is that capillary waves are generated on the liquid surface causing droplets to be propelled into the air. Generally, ultrasound has the effect of accelerating diffusion processes which normally occur at relatively low speeds. It is believed that the mechanism by which the water is atomized by the ultrasonic vibrations is based either on cavitation or wave motion caused after the liquid is transformed into a film form, and in particular that wave motion is indispensable to the atomization of the water in large quantities.

Water introduced into-the stem 3 is discharged radially through the holes 46. Simultaneously compressed air introduced into the resonator tube 4 is discharged through the gap between the tube and the stem 3 entering the cavity or well 44 in the head 42. As the compressed air accelerates and reaches the velocity of sound, resonant vibrations develop in the cavity of the head 42 and are transmitted as high frequency waves 169. The air drives the water downstream of the gun in an annular, diverging stream 170. The air and water streams mix more or less completely downstream of the gun. The resonator assembly performs as a primary, central nucleator, i.e. the waves 169 atomize water at the discharge end of the gun. Isentropic flow conditions at the air gap between the stem 3 and the tube 4 produce very low temperatures. Ice accumulation is most likely at this point. In order to avoid ice accumulation, water is discharged through the holes 46 immediately upstream of the resonator cavity. The water is chopped into fine droplets (0.1 to 10 microns) by the ultrasonic waves and entrained by the expanding compressed air flow for rapid evaporation and cooling downstream from the gun. Ultrasonic waves 169 atomize the water droplets in the stream 166. The droplet size is affected by the frequency of the waves, the spacing between the resonator chamber cavity or well 44 and the air outlet )between the stem 3 and the tube 4, and the air/water flow at the discharge end of the gun. The expanding air of the central ultrasonic nucleator promotes expansion and reduces the collapsing effect of the outer, high velocity, annular air jet (stream 167).

In its simplest form, the gun includes the water tube 5, the valve at the outlet end of the water tube defined by the shoulder 71 on the resonator tube 4, and a central nucleator assembly for receiving air from a source thereof under pressure and for producing a central stream of fine ice particles. Moreover, even when the inner and outer shells 9 and 10, respectively are used, the resonator assembly can be another form of nucleator for receiving air under pressure to produce a central stream of fine ice particles which act as nuclei or seeds for promoting the production of snow in the mixed streams 166 of 167 of water and air respectively. If desired a valve (not shown) is provided in the air inlet pipe 46, and the peripheral air stream 167 is used only as a booster for marginal temperatures.

The use of the gun permits the use of a constant air supply independently of ambient air temperature. The energy supply is constant as is the case with fan type machines. Water volume is controlled using a valve in the gun rather than making water pressure adjustments (as is done in existing guns). Thus high water pressure can be maintained at marginal temperatures when the pressure is required to produce good quality snow.

Finally, the energy requirements of the gun of the present invention are only slightly higher than those for fan type machines, and are substantially lower than those for the best performing existing compressed air guns.

The embodiments of the invention in which an exclusive property or privilege is claimed are defined as follows:

1. A snowmaking gun comprising:

(a) casing means including (i) outer shell means (10), (ii) inner shell means (9) defining an air chamber (145) and nozzle means (11) for discharging air from said air chamber (145) in an outer annular stream of air;

(b) water tube means (5) extending substantially entirely through said inner shell means (9) for receiving water from a source of water under pressure, said water tube means (5) having an outlet end (78) for discharging the water from the gun; characterized by (c) valve means (71,78) at said outlet end (78) of said water tube means (5) for controlling the volume of water discharged from said water tube means (5), and for shaping the water into a primary thin, annular film of water which then turns into an intermediate annular stream of small water droplets for discharge into the center of an outer annular stream of air exiting said nozzle means (11) for mixing with said outer annular stream of air downstream of the discharge end of the gun for producing snow, temperature permitting; and (d) resonator means (3,4) extending through said water tube means (5) for receiving moist air from a source thereof under pressure, and for producing a central stream of fine ice particles which act as nuclei for promoting the production of snow.

2. A snowmaking gun according to claim 1, wherein said nucleator means (3,4) is an ultrasonic resonator for receiving air and water from sources thereof under pressure, and for producing an annular central stream of fine water droplets in air while creating ultrasonic waves downstream of the outlet.

3. A snowmaking gun according to claim 2, including turbine means (8) at said outlet end (78) of sand valve means (71,78) for promoting the atomization of the water in said intermediate stream into small droplets, said turbine means (8) being located immediately downstream of said nozzle means (11) in the direction of water flow.

4. A snowmaking gun according to claim 3, including manifold means (1) connected to said water tube means (5) and to said resonator means (3,4) for connecting said water tube means (5) and said resonator means (3,4) to a source of water under pressure, and for connecting said resonator means (3,4) to a source of air under pressure.

5. A snowmaking gun according to claim 3, wherein said resonator means (3,4) includes resonator tube means (4) in said water tube means (5) for receiving air under pressure; tubular stem means (3) extending through and beyond the outlet end of said resonator tube means (4) for receiving water from a source thereof under pressure; head means (42) on an end of said stem means (3) downstream of the outlet end of said resonator tube means (4); and radially extending outlet orifice means (46) in said stem means (3) immediately upstream of said head means (42) for discharging water under pressure radially into the stream of air.

6. A snowmaking gun according to claim 4, wherein said resonator means (3,4) includes resonator tube means (4) extending out of said manifold means (1) for receiving air under pressure; tubular stem means (3) extending out of said manifold means (1) through and beyond an outlet end of said resonator tube means (4) for receiving water from a source thereof under pressure; head means (42) on a discharge end of said stem means (3) downstream of the outlet end of said resonator tube means (4); and radially extending outlet orifice means (46) in said stem means (3) immediately upstream of said head means (42) for discharging water under pressure radially into the stream of air and for creating ultrasonic vibrations in mixing air and water streams downstream of the gun in the direction of fluid flow.

7. A snowmaking gun according to claim 6, wherein said valve means (71,78) includes shoulder means (71) on said resonator tube means (4) partially closing the outlet end (78) of said water tube means (5) for creating said annular intermediate stream of water.

8. A snowmaking gun according to claim 7, including water volume control sleeve means (6) carrying said water tube means (5); first pin means (91) between said volume control sleeve means (6) and said water tube means (5) permitting longitudinal movement while preventing rotation of said water tube means (5) in said volume control sleeve means (6); and first cam means (81) in said volume control sleeve means (6) engaging said water tube means (5), rotation of said cam means (81) causing longitudinal movement of said water tube means (5) relative to said shoulder means (71) to vary the size of the water discharge opening and consequently the volume of water flowing through the valve means (71,78).

9. A snowmaking gun according to claim 8, including control ring means (84) rotatable on said volume control sleeve means (6) and engaging said first cam means (81) for rotating the latter in said volume control sleeve means (6).

10. A snowmaking gun according to claim 5, including pattern control sleeve means (7) on an end of said water tube means (5) remote from said manifold means (1), said pattern control sleeve means (7) being concentric with and engaging the outlet end (78) of said water tube means (5), longitudinal movement of said pattern control sleeve means (7) with respect to said water tube means (5) serving to alter the initial flow pattern of the stream of water between generally cylindrical and diverging; and latch means (97,108,109,111) on said pattern control sleeve means (7) for locking the pattern control sleeve means (7) on the water tube means (5) to provide a chosen flow pattern for the intermediate stream of water.

11. A snowmaking gun according to claim 10, wherein said latch means (97,108,109,111) includes helical groove means (97) in said water tube means (5), and arcuate second cam means (111) for engaging said groove means (97) to lock the pattern control sleeve means (7) in one position on the water tube means (5).

12. A snowmaking gun according to claim 10, wherein said turbine means (8) includes a ring (123) rotatably mounted on the downstream end of said pattern control sleeve means (7), and teeth (124) extending axially inwardly from the ring (123) for intercepting the stream of water, whereby the water pressure causes rapid rotation of the ring (123) and chopping of the water into small droplets by the teeth (124).

13. A snowmaking gun according to claim 3, wherein said nozzle means (ll) includes a plurality of individual nozzles (11) in an outlet end of said outer shell means (10), whereby the air is first discharged from said air chamber (145) in small individual streams for mixing downstream of the gun to define said outer annular stream.

* * * * *